US011311172B2

(12) United States Patent
Terrádez Alemany et al.

(10) Patent No.: US 11,311,172 B2
(45) Date of Patent: Apr. 26, 2022

(54) HOUSEHOLD DISHWASHER MACHINE AND METHOD FOR OPERATING A HOUSEHOLD DISHWASHER MACHINE

(71) Applicant: BSH Hausgeräte GmbH, Munich (DE)

(72) Inventors: Maria Terrádez Alemany, Munich (DE); Kai Paintner, Welden (DE); Matthias Heckes, Munich (DE); Daniel Hitzler, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 192 days.

(21) Appl. No.: 16/616,997

(22) PCT Filed: Jul. 6, 2018

(86) PCT No.: PCT/EP2018/068353
§ 371 (c)(1),
(2) Date: Nov. 26, 2019

(87) PCT Pub. No.: WO2019/015996
PCT Pub. Date: Jan. 24, 2019

(65) Prior Publication Data

US 2021/0127942 A1 May 6, 2021

(30) Foreign Application Priority Data

Jul. 19, 2017 (DE) ..... 10 2017 212 333.8

(51) Int. Cl.
*A47L 15/42* (2006.01)

(52) U.S. Cl.
CPC ..... *A47L 15/4295* (2013.01); *A47L 15/4246* (2013.01); *A47L 2401/04* (2013.01); *A47L 2501/26* (2013.01)

(58) Field of Classification Search
None
See application file for complete search history.

(56) References Cited

U.S. PATENT DOCUMENTS 7,927,427 B2 * 4/2011 Classen ..... A47L 15/4295 134/18
2011/0248609 A1 10/2011 Hoepfl et al.
2017/0202426 A1 7/2017 Bosen et al.
2018/0214001 A1 8/2018 Woebkemeier

FOREIGN PATENT DOCUMENTS

DE 10048081 A1 4/2002
DE 10048086 A1 4/2002

OTHER PUBLICATIONS

International Search Report PCT/EP2018/068353 dated Sep. 5, 2018.
National Search Report DE 10 2017 212 333.8 dated Apr. 17, 2018.

* cited by examiner

*Primary Examiner* — Rita P Adhlakha
(74) *Attorney, Agent, or Firm* — Michael E. Tschupp; Andre Pallapie; Brandon G. Braun

(57) ABSTRACT

A household dishwasher includes a dishwasher cavity for accommodating items to be washed, a controller apparatus configured to perform one wash program from a number of wash programs for washing the items to be washed arranged in the dishwasher cavity, an optical sensor configured to capture an optical sensor signal of the items to be washed arranged in the dishwasher cavity, and an evaluating unit configured to ascertain a loading state of the dishwasher cavity as a function of the captured optical sensor signal of the items to be washed.

15 Claims, 4 Drawing Sheets

HOUSEHOLD DISHWASHER MACHINE AND METHOD FOR OPERATING A HOUSEHOLD DISHWASHER MACHINE

CROSS-REFERENCES TO RELATED APPLICATIONS

This application is the U.S. National Stage of International Application No. PCT/EP2018/068353, filed Jul. 6, 2018, which designated the United States and has been published as International Publication No. WO 2019/015996 A1 and which claims the priority of German Patent Application, Serial No. 10 2017 212 333.8, filed Jul. 19, 2017, pursuant to 35 U.S.C. 119(a)-(d).

BACKGROUND OF THE INVENTION

The present invention relates to a household dishwasher and also a method for operating a household dishwasher.

For an optimal cleaning result of items to be washed using a dishwasher, it is advantageous to arrange the items to be washed in the dishwasher in the manner intended by the manufacturer. This intended arrangement is often not easily identifiable for the user, in particular if items with a wide variety of sizes are to be washed. It is also not easy for users to estimate whether further items to be washed can be accommodated when a dishwasher is partially loaded, or also where said items to be washed can be placed.

DE 10 2004 035 847 A1 describes a method for identifying the loading of a dishwasher with items to be washed. For this purpose, an image capturing system is used, which captures a three-dimensional image of the dishwasher interior, by means of which the type and/or quantity of items to be washed is ascertained.

BRIEF SUMMARY OF THE INVENTION

Against this background, an object of the present invention consists in creating an improved household dishwasher.

Accordingly, a household dishwasher is proposed with a dishwasher cavity for accommodating items to be washed and a controller apparatus for performing one wash program from a number of wash programs for washing the items to be washed arranged in the dishwasher cavity. The household dishwasher has an optical sensor for capturing an optical sensor signal of the items to be washed arranged in the dishwasher cavity and an evaluating unit. The evaluating unit is configured to ascertain a loading state of the dishwasher cavity as a function of the captured optical sensor signal of the items to be washed.

Using this household dishwasher, it is advantageously possible to optimize the operation of the household dishwasher, as it is possible to ascertain the loading state of the dishwasher cavity with items to be washed. For example, notices regarding the optimal loading can be given to a user and/or an optimal wash program can be selected and performed as a function of the loading state. The optimal use of the household dishwasher results in advantages for the user with regard to an achieved cleaning performance and costs incurred due to the consumption of power, water and/or cleaning agent, whereby it is also possible to reduce the environmental burden. By optimally loading the household dishwasher, it is further possible to ensure that the utilization of the household dishwasher is optimal each time the wash program is performed, so that the household dishwasher is thus neither overloaded nor has a large amount of free capacity.

In the present case, the loading state of the dishwasher cavity is understood to be a quantity of items to be washed, a type of items to be washed, an arrangement of the items to be washed in the dishwasher cavity and/or a distribution of the items to be washed in the dishwasher cavity.

In this context, the type of items to be washed in particular comprises a shape of the items to be washed, for example such as a flat plate, a deep bowl, a pot, a pan, a glass and the like, as well as a material of the items to be washed, for example such as ceramic, porcelain, metal, plastic and the like.

The arrangement of the items to be washed in the dishwasher cavity is understood in particular to be how different items to be washed are arranged and/or oriented in the dishwasher cavity, in particular in a receptacle for items to be washed. For example, a number of plates can be placed in a row one behind the other in a suitable receptacle for items to be washed, which makes it possible to arrange a large number of plates in the dishwasher cavity. On the other hand, a plate can also be placed in the receptacle for items to be washed which requires a large amount of space, but improves a cleaning of the plate arranged in a horizontal manner, which may be desired if the plate is highly soiled.

The distribution of the items to be washed in the dishwasher cavity is understood in particular as the position in a receptacle for items to be washed at which an item to be washed is arranged. Particularly if the dishwasher cavity has a multiplicity of receptacles for items to be washed, the distribution also comprises an item of information regarding the receptacle for items to be washed in which a particular item to be washed is arranged There may be provision, for example, for pots and pans, which particularly have a great degree of soiling, to be arranged in a lower receptacle for items to be washed, as a water pressure for washing the items to be washed is higher there than in an upper receptacle for items to be washed for example, which means that the cleaning performance is increased.

The controller apparatus may be implemented in a hardware-based and/or also software-based manner. If implemented in a hardware-based manner, the controller apparatus may for example be embodied as a computer or as a microprocessor. If implemented in a software-based manner, the controller apparatus may be embodied as a computer program product, as a function, as a routine, as part of a program code or as an executable object.

The controller apparatus is configured for performing one wash program from a number of wash programs. The number for example comprises different wash programs, such as an energy-saving wash program, a glass-care wash program, an intensive wash program, an automatic wash program and/or a machine-cleaning wash program. The various wash programs in particular differ in a sequence of sub-program steps and/or in parameter values for the individual sub-program steps. Sub-program steps in particular comprise a pre-rinse, a cleaning, a rinsing with rinse-aid and a drying. Parameter values in particular comprise a washing liquor temperature, a quantity of fresh water supplied, a pump speed of a recirculating pump, an amount of dosed cleaning agent, an amount of dosed rinse-aid, a point in time of adding the cleaning agent and/or the rinse-aid, a duration of a sub-program step and/or an activation of further supporting units, such as a zeolite drying apparatus for example.

The household dishwasher comprises a dishwasher cavity, which for example is formed by a bottom, a ceiling, a rear wall and two side walls and which represents a cuboid which is open on one side. The open side in particular may be closed off by a door which can be pivoted about a pivot axis.

For example, a plurality of receptacles for items to be washed are provided for accommodating the items to be washed, which are arranged in the dishwasher cavity such that they can be pulled out. In particular, each receptacle for items to be washed may be assigned a spray arm in each case, which is configured to apply washing liquor to the items to be washed arranged in the respective receptacle for items to be washed while a wash program is being performed. As an alternative or in addition, a spray arm may be provided for a plurality of receptacles for items to be washed. Furthermore, spray nozzles may be provided in the ceiling and/or in one of the side walls.

The optical sensor is in particular embodied as an optoelectronic sensor, which supplies an analog electrical signal as a function of an optical signal as the optical sensor signal. This offers the advantage that the optical sensor is produced and can be used on a microchip in an integrated design and thus in a space-saving, material-saving and cost-effective manner. The analog electrical signal is further able to be converted into a digital signal with little outlay, for example by means of an A/D converter, and subsequently can be processed digitally.

The optical sensor is arranged in the household dishwasher in such a manner that it captures an optical sensor signal of the items to be washed of the household dishwasher. This is fulfilled, for example, if a line of sight from the optical sensor to the items to be washed is present. For example, the optical sensor is arranged on the ceiling of the dishwasher cavity, on the rear wall of the dishwasher cavity and/or on a door of the household dishwasher, which in the closed state forms the washing chamber with the dishwasher cavity. To this extent, when the dishwasher cavity is empty, the optical sensor captures an optical signal of the empty dishwasher cavity and/or of the empty receptacle(s) for items to be washed. There may be further provision for a plurality of optical sensors to be used, wherein each optical sensor captures an optical sensor signal of a region of the dishwasher cavity and/or of the receptacles for items to be washed assigned to the respective optical sensor. In particular, with a plurality of receptacles for items to be washed, it is advantageous for an optical sensor to be provided for each of the receptacles for items to be washed.

The optical sensor captures the optical sensor signal while the dishwasher cavity is being loaded with items to be washed. For example, the optical sensor captures the optical sensor signal when the door of the household dishwasher is open and at least one receptacle for items to be washed is in a pulled-out state. The optical sensor may also be configured to capture the optical sensor signal when the door of the household dishwasher is closed. To this end, it is advantageous to provide an illumination device in the dishwasher cavity. The optical sensor may further be configured to capture the optical sensor signal while the wash program is being performed.

The optical sensor signal of the items to be washed, in addition to an item of information on the items to be washed themselves, also comprises an item of information on whether no items to be washed are in the dishwasher cavity or the positions at which there are no items to be washed, provided that the dishwasher cavity is partially loaded with items to be washed. The region captured by the optical sensor is also referred to as sensing region in the following.

The optical sensor is in particular configured to capture the optical sensor signal over a wide spectral range, which is not limited to the optical spectral range. For example, the optical sensor comprises an infrared sensor. By way of a spectral analysis of an infrared optical sensor signal, chemical compounds can be identified for example, whereby a material of the items to be washed can be ascertained. Furthermore, soiling on the items to be washed can be identified.

The optical sensor for example comprises a camera, in particular a digital camera, for example with a CCD sensor (CCD: Charged Coupled Device). The camera for example captures an image and/or a video of the sensing region.

An illumination device may be provided for support, which illuminates the sensing region. This illumination device may, in particular, be embodied as a narrowband light source, such as a laser for example. Alternatively, the illumination device may be embodied as a wideband light source, such as a lightbulb and/or a flash device.

The evaluating unit may be implemented in a hardware-based and/or also software-based manner. If implemented in a hardware-based manner, the evaluating unit may for example be embodied as a computer or as a microprocessor. If implemented in a software-based manner, the evaluating unit may be embodied as a computer program product, as a function, as a routine, as part of a program code or as an executable object. The evaluating unit may in particular be embodied as part of the controller apparatus.

The evaluating unit is configured to ascertain the loading state of the dishwasher cavity with items to be washed as a function of the captured optical sensor signal. For example, the evaluating unit processes and/or analyzes the optical sensor signal for this purpose. The evaluating unit may for example be configured to compile a three-dimensional image of the items to be washed arranged in the dishwasher cavity as a function of the optical sensor signal and to derive loaded regions and/or free regions from the three-dimensional image and to identify the arranged items to be washed. To this end, the evaluating unit may use a pattern recognition.

The loading state ascertained by the evaluating unit comprises, for example, the information that five glasses and two plates are arranged on the upper receptacle for items to be washed with their opening facing downward, and that in a rear region of the upper receptacle for items to be washed there is still free space for further items to be washed.

If the optical sensor is embodied as a camera, then the evaluating unit may in particular be configured to perform an image analysis of the optical sensor signal present as an image.

The evaluating unit is particularly configured to determine, as a function of the ascertained loading state of the dishwasher cavity, an optimal loading state in relation to the ascertained loading state. This means, for example, that the evaluating unit ascertains that an item to be washed is not arranged in an optimal place and/or is not arranged in an optimal orientation. For example, a pot should be arranged with its opening facing downward in the lower receptacle for items to be washed.

In accordance with one embodiment of the household dishwasher, the evaluating unit is configured, as a function of the captured optical sensor signal, to ascertain a quantity of items to be washed and/or a type of items to be washed in the dishwasher cavity.

The quantity of items to be washed particularly comprises an item of information regarding a number of individual objects to be washed. The type of items to be washed particularly comprises an item of information regarding a type of objects to be washed, such as plate, cup, bowl, pot, pan, glass, cutlery and the like, and/or regarding a material of an object to be washed.

In accordance with a further embodiment of the household dishwasher, the evaluating unit is configured, as a function of the captured optical sensor signal, to ascertain a distribution of items to be washed and/or an arrangement of items to be washed in the dishwasher cavity.

In accordance with a further embodiment of the household dishwasher, the evaluating unit is configured to determine an optimized loading state as a function of the ascertained loading state.

An optimized loading state is understood in particular as an arrangement and/or distribution of the items to be washed in the dishwasher cavity. An optimized loading state may also provide that only items to be washed made of glass are loaded for example, in order to perform a specific glass-cleaning program as the wash program. By contrast, it may be provided that no glass and/or otherwise sensitive items to be washed are loaded in order to perform an intensive wash program as the wash program.

As a result of the optimized loading state being determined as a function of the ascertained loading state, it is ensured that the current loading state is taken into consideration. Only in this way can individual differences in the loading be taken into consideration, as opposed to predefined loadings for example which do not take into consideration the current loading state.

In accordance with a further embodiment of the household dishwasher, this has an illumination device for illuminating the items to be washed arranged in the dishwasher cavity when capturing the optical sensor signal.

In accordance with a further embodiment of the household dishwasher, the optical sensor comprises a camera, wherein the optical sensor signal comprises an image and/or a video of the items to be washed.

There may be provision in embodiments of the household dishwasher for the user with an optical sensor integrated into a mobile device, in particular a camera of a smartphone, to capture a further optical sensor signal of the items to be washed, which can be transferred from the mobile device to the evaluating unit. The evaluating unit is configured for ascertaining the loading state of the dishwasher cavity as a function of the further optical sensor signal.

In accordance with a further embodiment of the household dishwasher, the evaluating unit is configured to perform an image analysis of the captured image and/or video in order to ascertain the loading state of the dishwasher cavity.

In accordance with a further embodiment of the household dishwasher, the evaluating unit is configured to perform a predetermined action as a function of the ascertained loading state.

The predetermined action may for example consist in starting a machine-cleaning program when the ascertained loading state outputs that no items to be washed are arranged in the dishwasher cavity.

In accordance with a further embodiment of the household dishwasher, it has a user interface, wherein the predetermined action comprises outputting an item of information to a user by means of the user interface.

The outputting of the information takes place, for example, via a display element, such as a display or a touchscreen, via a loudspeaker as an acoustic signal and/or via a communication unit, which transmits the information as a data signal to a receiver device configured for this purpose. The information particularly comprises notices regarding the ascertained loading state and/or regarding an optimized loading state. Many embodiments are conceivable for this purpose.

As a relatively simple embodiment, there may for example be provision for a percentage value to be displayed on a display of the household dishwasher, which represents the space already occupied by items to be washed in relation to a maximum capacity.

In an embodiment which is particularly convenient for the user, the ascertained loading state is transferred to a mobile device of the user, wherein the user may be shown the ascertained loading state on a display of the mobile device.

It is furthermore possible for example, when the dishwasher cavity is 90% loaded with items to be washed, for the information to comprise the notice that it may be advantageous for the user to start a wash program. This would be sensible, for example, if it is already the evening and after dinner, which the evaluating unit is able to derive for example due to an integrated clock and experience-based values of when items to be washed are sorted into the dishwasher cavity, as the performed wash program would then be finished by the next morning. Furthermore, it is possible in particular for an energy-saving wash program, which for example has a prolonged running time with lower energy consumption, to be performed at night without any negative effects.

In accordance with a further embodiment of the household dishwasher, the user interface is configured to transfer the ascertained loading state to a mobile device of the user.

In this context, the user interface advantageously comprises a communication unit, such as a modem and/or a network adapter for example. The transfer takes place for example by means of a data network, in particular a wireless data network, such as WLAN, Bluetooth, NFC, ZigBee and the like and/or by means of a mobile radio network. The mobile device is in particular a smartphone, with a suitable app running thereon.

In embodiments, the user interface is configured for bidirectional communication. It may then be provided, for example, that the user sends a control command, such as a starting command for performing a wash program for example, from his smartphone to the household dishwasher by means of the user interface.

In accordance with a further embodiment of the household dishwasher, it comprises a display element, wherein the outputting of the information to the user comprises a representation of the ascertained loading state on the display element.

In this context, a simple percentage value may be shown to a user, for example. There may be further provision for a graphical representation of the ascertained loading state to be shown. This lets a user rapidly understand whether there is enough space in the dishwasher cavity even with a closed door of the household dishwasher, and if yes, where there is still space.

In accordance with a further embodiment of the household dishwasher, it has an indicating apparatus, wherein the predetermined action comprises highlighting a position in the dishwasher cavity by means of the indicating apparatus.

The highlighting of the position in the dishwasher cavity makes it easier for a user to simply spot a position which is still free for arranging further items to be washed, for example. This is particularly advantageous when the dishwasher cavity is almost completely full. Furthermore, in this manner an optimized loading state may be marked for the user. This makes it easier for the user to achieve the optimized loading state.

The highlighting may for example take place on a display of the household dishwasher. An embodiment is particularly advantageous in which the position to be highlighted in the dishwasher cavity is marked directly, for example by illuminating it. For this purpose, the indicating apparatus comprises one or more lasers, for example, which illuminate the respective position by means of corresponding optics. In this context, it is also possible for different illumination colors to be used for different optimization measures and/or signal patterns, such as flashing. For example, free space may be illuminated in a simple manner with white light. If an item to be washed is not optimally arranged, for example a pot with its opening facing upward, then this can be illuminated in red. If an item to be washed is not optimally distributed, for example a pot in the upper receptacle for items to be washed, despite there still being space in the lower receptacle for items to be washed, then the pot can be illuminated in red and the optimal space which is still free illuminated in green. By way of such a representation, the loading state can be optimized for the user in a very simple and intuitive manner.

In accordance with a further embodiment of the household dishwasher, the predetermined action comprises a selection of the wash program to be performed and/or an automatic program start.

In this context, the evaluating unit is advantageously configured to select an optimal wash program as a function of the ascertained loading state. For example, there may be provision for high-pressure washing liquor to be applied to a lower receptacle for items to be washed by means of the spray arm assigned thereto, as said receptacle is, for example, fully loaded with plates which are arranged in a substantially vertical manner.

An automatic program start is then particularly advantageous if the user is away from home, on a business trip for example, for longer than 24 hours with a 50% loaded household dishwasher for example. This information can be obtained by the evaluating unit for example by the household dishwasher networking in a "smart home" network or also by accessing an electronic calendar of the user. It may also be provided that the user programs the household dishwasher accordingly, so that it automatically performs a wash program when the loading state is above 50%, or even above 70%, at midnight for example, so that the cleaned items to be washed are available in the morning.

In embodiments of the household dishwasher, further provision is made for the evaluating unit to preprocess the captured optical sensor signal and to send the preprocessed optical sensor signal to a server in a network, such as the Internet for example, by means of a communication unit. In particular, the server has a multiple of the computing power of the evaluating unit and is therefore able to apply more complex analysis methods, without ascertaining the loading state requiring an excessive amount of time. The server then transfers the ascertained loading state back to the evaluating unit via the network. In this embodiment, the evaluating unit may be designed to be particularly simple, as no elaborate evaluation routines are handled by it.

In accordance with a further aspect, a method for operating a household dishwasher is proposed with a dishwasher cavity for accommodating items to be washed, and a controller apparatus for performing one wash program from a number of wash programs for washing the items to be washed arranged in the dishwasher cavity. In a first method step, an optical sensor signal of the items to be washed arranged in the dishwasher cavity is captured by means of an optical sensor. In the second method step, a loading state of the dishwasher cavity is ascertained as a function of the captured optical sensor signal of the items to be washed by means of an evaluating unit.

This method advantageously makes it possible to optimize the operation of the household dishwasher in relation to the loading with items to be washed.

The embodiments and features described for the proposed household dishwasher apply correspondingly to the proposed method.

Furthermore, a computer program product is proposed which causes the method, as described above, to be carried out on a program-controlled device.

A computer program product such as e.g. a computer program means, for example can be provided or supplied as a storage medium such as e.g. a memory card, USB stick, CD-ROM, DVD, or even in the form of a downloadable file from a server in a network. This may take place, for example, in a wireless communications network by transferring a corresponding file containing the computer program product or the computer program means.

Further possible implementations of the invention also include combinations of features or embodiments described above or below with regard to exemplary embodiments, even if these combinations are not mentioned explicitly. In this context, the person skilled in the art will also add individual aspects as improvements or enhancements to the respective basic form of the invention.

BRIEF DESCRIPTION OF THE DRAWINGS

Further advantageous embodiments and aspects of the invention form the subject matter of the subclaims and of the exemplary embodiments of the invention that are described below. The invention is also described in greater detail on the basis of preferred forms of embodiment with reference to the attached figures.

DETAILED DESCRIPTION OF EXEMPLARY EMBODIMENTS OF THE PRESENT INVENTION

Figure 1:
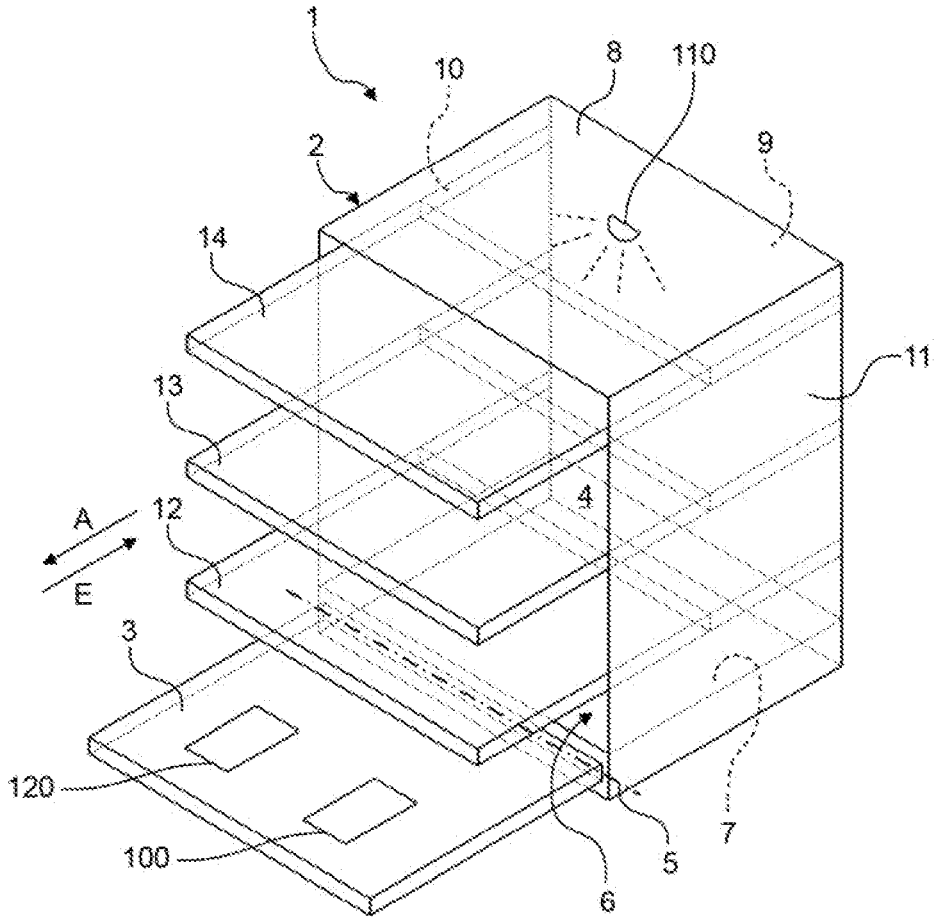
FIG. 1 shows a schematic perspective view of an exemplary embodiment of a household dishwasher.

In the figures, elements that are identical or have the same function are provided with the same reference characters unless specified otherwise.

FIG. 1 shows a schematic perspective view of an exemplary embodiment of a household dishwasher 1. The household dishwasher 1 comprises a dishwasher cavity 2, which is able to be closed off by a door 3, in particular in a watertight manner. A sealing facility (not shown) may be provided for this purpose between the door 3 and the dishwasher cavity 2. The dishwasher cavity 2 is preferably cuboid in shape. The dishwasher cavity 2 may be arranged in a housing of the household dishwasher 1. The dishwasher cavity 2 and the door 3 may form a washing chamber 4 for washing items to be washed 15, 16 (see FIG. 2).

The door 3 is shown in its open position in FIG. 1. The door 3 may be closed or opened by pivoting about a pivot axis 5 provided at a lower end of the door 3. With the aid of the door 3, a loading opening 6 of the dishwasher cavity 2 can be closed or opened. The dishwasher cavity 2 has a bottom 7, a ceiling 8 arranged opposite to the bottom 7, a rear wall 9 arranged opposite the closed door 3 and two side walls 10, 11 arranged opposite one another. The bottom 7, the ceiling 8, the rear wall 9 and the side walls 10, 11 may be manufactured from a stainless steel sheet for example. Alternatively, the bottom 7 may be manufactured from a plastic material.

Furthermore, the household dishwasher 1 has at least one receptacle for items to be washed 12, 13, 14. Preferably, a plurality of receptacles for items to be washed 12, 13, 14, for example three, may be provided, wherein the receptacle for items to be washed 12 may be a lower receptacle for items to be washed or a lower basket, the receptacle for items to be washed 13 may be an upper receptacle for items to be washed or an upper basket and the receptacle for items to be washed 14 may be a cutlery drawer. As additionally shown in FIG. 1, the receptacles for items to be washed 12, 13, 14 are arranged above one another in the dishwasher cavity 2. Each receptacle for items to be washed 12 to 14 is optionally able to be shifted into or out from the dishwasher cavity 2. Each receptacle for items to be washed 12, 13, 14 is able be inserted into the dishwasher cavity 2 in an insertion direction E and pulled out from the dishwasher cavity 2 in a pull-out direction A opposite to the insertion direction E.

The household dishwasher 1 additionally has a controller apparatus 100 and also an evaluating unit 120, which are arranged on the door 3. An optical sensor 110 embodied as a camera is arranged on the ceiling 8, so that it is configured for capturing an optical sensor signal of the items to be washed 15, 16 arranged in the dishwasher cavity 2 (see FIG. 2). The dashed lines below the camera 110 indicate a capture region of the camera 110.

By combining the camera 110 and the evaluating unit 120, it is advantageously possible to ascertain a loading state of the dishwasher cavity 2. This is explained in more detail below with reference to FIG. 2.

Figure 2:
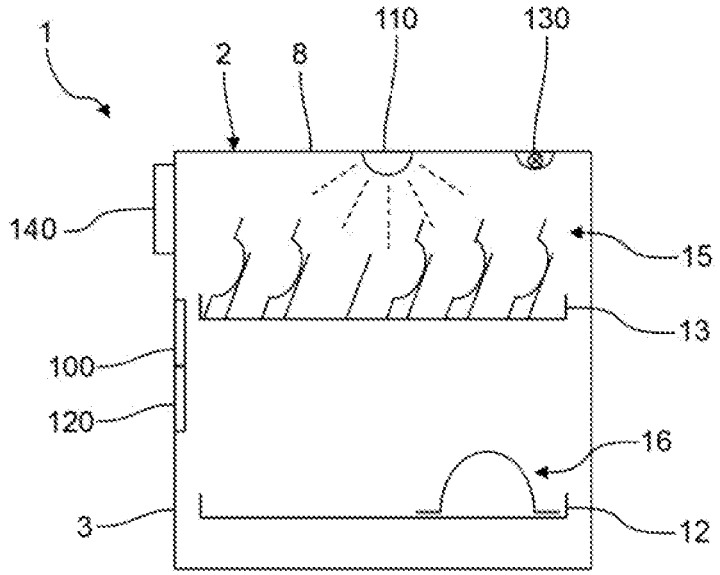
FIG. 2 shows a schematic side view of a further exemplary embodiment of a household dishwasher.

FIG. 2 shows a schematic side view of a further exemplary embodiment of a household dishwasher 1, for example a variant of the household dishwasher 1 in FIG. 1.

In the representation in FIG. 2, the door 3 of the household dishwasher 1 is closed. A lower receptacle for items to be washed 12 and an upper receptacle for items to be washed 13 are arranged in the dishwasher cavity 2. Arranged on the door 3 are a controller apparatus 100 and an evaluating unit 120. Furthermore, a display element 140 embodied as a digital display is arranged on the front side of the door 3. Arranged on the ceiling 8 are an optical sensor 110 and an illumination device 130. Moreover, a further optical sensor 110 may be arranged on a side wall 10, 11 of the dishwasher cavity 2 for example (not shown). The use of a plurality of optical sensors 110 is advantageous in order to capture the entire dishwasher cavity 2, in particular the entirety of the items to be washed 15, 16 arranged therein. For example, a large item to be washed 15, 16, such as a bowl, may partially cover a sensing region of an optical sensor 110, so that an item to be washed 15, 16 lying behind from the perspective of the optical sensor 110 is not captured. By correspondingly arranging one or more further optical sensors 110, this problem can be solved.

The situation shown corresponds to a partial loading of the dishwasher cavity 2 of the household dishwasher 1. The lower receptacle for items to be washed 12 is loaded with an item to be washed 16, which here is embodied as a large salad bowl. The upper receptacle for items to be washed 13 is loaded with five items to be washed 15, which are each embodied as plates.

The optical sensor 110 is configured to capture an optical sensor signal of the item to be washed 15, 16. In the present case, the optical sensor 110 is supported by an illumination device 130 for this purpose. Together, the optical sensor with the illumination device 130 forms a laser scanner for example. The optical sensor 110 further comprises an imaging camera, in order to increase an informational content of the captured optical sensor signal. For example, the optical sensor 110 already captures the optical sensor signal when loading a respective receptacle for items to be washed 12, 13 with items to be washed. Because the capturing already happens during the loading, which in particular takes place with a pulled-out receptacle for items to be washed 12, 13, the optical sensor 110 advantageously captures a number of optical sensor signals of the items to be washed 15, 16 at different viewing angles in each case. From these optical sensor signals captured at different viewing angles, it is possible to ascertain the loading state in a particularly reliable manner. The optical sensor 110 provides the captured optical sensor signal to the evaluating unit 120.

The evaluating unit 120 is embodied for example as a digital signal processor. This processes the optical sensor signal digitally and ascertains a loading state therefrom. Should the optical sensor signal be provided as an analog electrical signal, an A/D converter assigned to the digital signal processor converts the analog signal into a digital signal.

The digital signal processor 120 is particularly configured to perform a predetermined action as a function of the ascertained loading state. This is explained in more detail below with reference to both FIGS. 3*a* and 3*b*.

Figure 3A:
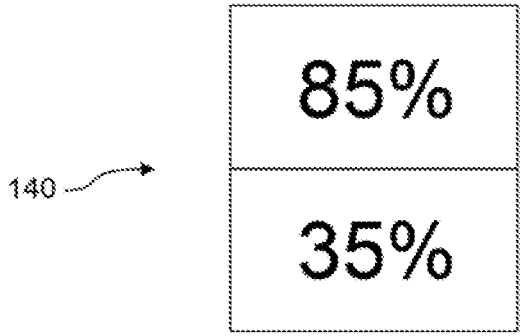
FIGS. 3*a* and 3*b* each show an exemplary embodiment of a display element for displaying a loading state of a household dishwasher.
Figure 3B:
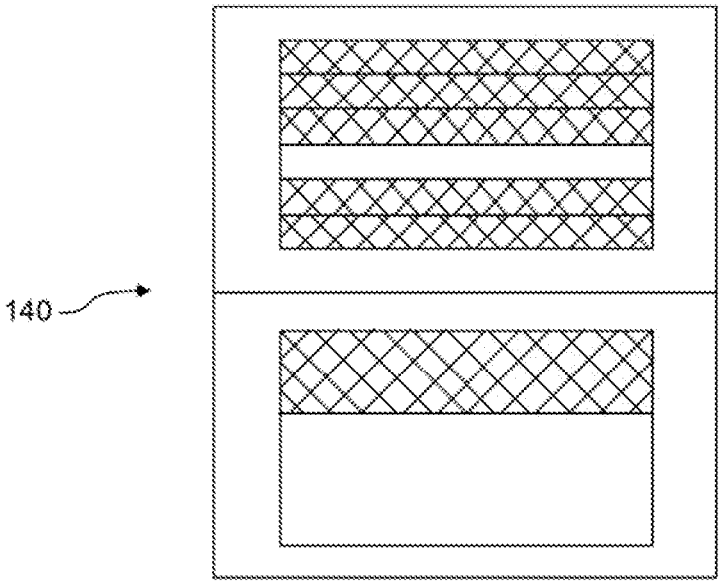

FIGS. 3*a* and 3*b* each show an exemplary embodiment of a display element 140 for displaying a loading state of a household dishwasher 1, in particular of the household dishwasher 1 in FIG. 1 or FIG. 2. The predetermined action, which the evaluating unit 120 performs in this context, is the outputting of the ascertained loading state by means of the display element 140.

FIG. 3*a* shows an exemplary embodiment of the display element 140 which has been kept particularly simple. In this context, the display element 140 is configured to represent a percentage as the respective loading state for two receptacles for items to be washed 12, 13 (see FIG. 1 or FIG. 2), in particular for a lower receptacle for items to be washed 12 and for an upper receptacle for items to be washed 13. To this end, the evaluating unit 120 (see FIG. 1 or FIG. 2) ascertains for example the loading state of a respective receptacle for items to be washed 12, 13 as a percentage, wherein 0% corresponds to a completely unloaded or empty receptacle for items to be washed 12, 13 and 100% corresponds to a completely loaded or full receptacle for items to be washed 12, 13. Here, the upper half of the display element 140 indicates the loading state of the upper receptacle for items to be washed 13 and the lower half indicates the loading state of the lower receptacle for items to be washed 12. The percentages shown correspond, for example, to the value which would be ascertained with a loading as shown in FIG. 2.

FIG. 3*b* shows a somewhat more complex exemplary embodiment of the display element 140. It has been conceived as already shown in FIG. 2*a*, wherein instead of a percentage value a graphical representation is shown of space which is occupied and space which is still free in a respective receptacle for items to be washed 12, 13. The graphical representation of the loading state shown again corresponds for example to the loading state which would be ascertained with a loading as shown in FIG. 2. The upper half of the display element 140 again shows the loading of the upper receptacle for items to be washed 13. In this context, a total of six rows for the accommodation of items to be washed 15, 16 can be identified, wherein the third row from the bottom, which in this representation corresponds to the third row from the left in FIG. 2, is still empty. For this reason, it is shown without texture. The other five rows are each loaded with a plate 15, for which reason they are shown as occupied by a texture. Accordingly, the lower half of the display element 140 indicates the loading state of the lower receptacle for items to be washed 12. In this context, the lower region is shown without a texture to over halfway, which corresponds to a free capacity. Only the upper region is shown with a texture, as the salad bowl 16 is arranged there.

The representation in FIG. 3*b* is more complex and contains more information than that of FIG. 3*a*. On the one hand, this has the advantage that a user is in particular able to estimate whether there is still free space for a large item to be washed. On the other hand, it takes somewhat longer to understand the loading state. In advantageous embodiments, it may therefore be provided that the two displays are combined, for example by a secondary representation or by an option of switching between the representations. In particular, there may be provision for example that it is detected by a proximity sensor (not shown) whether a user remains in the vicinity of the household dishwasher 1. If the user is close to the household dishwasher 1, then the more complex view is shown in accordance with FIG. 3*b* for example. If the user is further away, then the view in FIG. 3*a*, which is simple to understand, is shown with large numbers, which also remain readily understandable at a greater distance from the household dishwasher 1.

In addition to these two exemplary embodiments of a representation of the loading state, many others are conceivable.

Not shown, but likewise possible, are exemplary embodiments, in which the predetermined action performed by the evaluating unit 120 as a function of the ascertained loading state comprises a determination of an optimized loading state and an outputting of the optimized loading state. The outputting of the ascertained and/or of the optimized loading state may further take place by means of a communication unit (not shown), in particular to a mobile device, such as a smartphone, of the user. An automatic selection of an optimal wash program while taking into consideration the loading state and/or an automatic starting of a wash program are also possible as the predetermined action.

Figure 4:
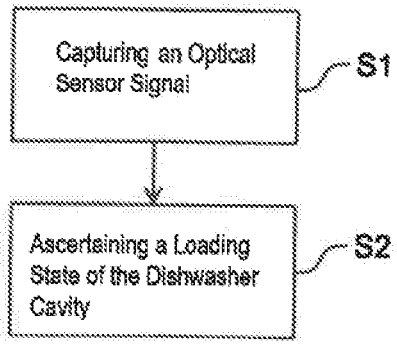
FIG. 4 shows a schematic block diagram of an exemplary embodiment of a method for operating a household dishwasher.

FIG. 4 shows a schematic block diagram of an exemplary embodiment of a method for operating a household dishwasher 1, in particular the household dishwasher 1 in FIG. 1 or FIG. 2.

In a first method step S1, an optimal sensor signal of items to be washed 15, 16 arranged in a dishwasher cavity 2 (see FIG. 1 or FIG. 2) of the household dishwasher 1 is captured by means of an optical sensor 110.

The optical sensor 110 is, for example, embodied on a camera, which captures a large number of images at different points in time.

In a second method step S2, an evaluating unit 120 ascertains a loading state of the dishwasher cavity 2 as a function of the captured optical sensor signal.

For example, to this end the evaluating unit 120 performs an image analysis of each image of the large number of captured images, while taking into consideration the different points in time of the capture. Furthermore, the evaluating unit 120 may stipulate, by means of a comparison of two images in each case, at which point new items to be washed have been sorted.

Although the present invention has been described with reference to exemplary embodiments, it can be modified in numerous different ways. For example, the information regarding the loading state may be used in combination with further usage data of the household dishwasher in order to achieve an intelligent automatic control of the household dishwasher. For example, an automatic program start may also be sensible with a low loading state, if from experience-based values it is known that no items to be washed usually accumulate over weekends, in order to prevent a buildup of odors in this manner. In this context, the further usage data may be collected as experience-based values during the course of the use and/or further data sources, such as an electronic calendar of a user for example, may be called on.

The invention claimed is:

1. A household dishwasher, comprising:

a dishwasher cavity for accommodating items to be washed;

a controller apparatus configured to perform one wash program from a plurality of wash programs for washing the items to be washed arranged in the dishwasher cavity;

an optical sensor configured to capture an optical sensor signal of the items to be washed arranged in the dishwasher cavity;

an evaluating unit configured to ascertain a loading state of the dishwasher cavity as a function of the captured optical sensor signal of the items to be washed; and a user interface, wherein the evaluating unit is configured to perform a predetermined action as a function of the ascertained loading state, wherein the predetermined action comprises outputting an item of information to a user via the user interface, and wherein the user interface comprises a display element, wherein the outputting of the information to the user comprises one of a percentage value of the ascertained loading state on the display element or a graphical representation of the ascertained loading state on the display element.

2. The household dishwasher of claim 1, wherein the evaluating unit is configured, as a function of the optical sensor signal, to ascertain a quantity of items to be washed and a type of items to be washed in the dishwasher cavity.

3. The household dishwasher of claim 1, wherein the evaluating unit is configured, as a function of the optical sensor signal, to ascertain a distribution of items to be washed and/or an arrangement of items to be washed in the dishwasher cavity.

4. The household dishwasher of claim 1, wherein the evaluating unit is configured to determine an optimized loading state as a function of the ascertained loading state.

5. The household dishwasher of claim 1, further comprising an illumination device for illuminating the items to be washed arranged in the dishwasher cavity when capturing the optical sensor signal.

6. The household dishwasher of claim 1, wherein the optical sensor comprises a camera, with the optical sensor signal comprising an image and/or a video of the items to be washed.

7. The household dishwasher of claim 6, wherein the evaluating unit is configured to perform an image analysis of the captured image and/or video in order to ascertain the loading state of the dishwasher cavity.

8. The household dishwasher of claim 1, wherein the user interface is configured to transfer the ascertained loading state to a mobile device of the user.

9. The household dishwasher of claim 1, further comprising an indicating device, wherein the predetermined action comprises a highlighting of a position in the dishwasher cavity by the indicating device.

10. The household dishwasher of claim 1, wherein the predetermined action comprises a selection of the wash program to be performed and/or an automatic program start.

11. The household dishwasher of claim 1, wherein the percentage value of the ascertained loading state shown on the display element represents an amount of space that is already occupied by the items to be washed.

12. The household dishwasher of claim 1, wherein the graphical representation of the ascertained loading state shown on the display element represents an amount of space that is already occupied by the items to be washed and an amount of space that is still free for items to be washed.

13. A method for operating a household dishwasher, said method comprising:

capturing by an optical sensor an optical sensor signal of items to be washed in a dishwasher cavity of the household dishwasher;

ascertaining by an evaluating unit a loading state of the dishwasher cavity as a function of the captured optical sensor signal of the items to be washed; and selecting a wash program from a plurality of wash programs for washing items to be washed as a function of the loading state, wherein the evaluating unit os configured to perform a predetermined action as a function of the ascertained loading state, the predetermined action comprising outputting an item of information to a user interface having a display element, and wherein the outputting of the information to the user comprises one of a percentage value of the ascertained loading state on the display element or a graphical representation of the ascertained loading state on the display element.

14. A computer program product for operating a household dishwasher, comprising a program-controlled device having stored therein a computer program embodied in a non-transitory computer readable medium, wherein the computer program, when loaded into the program-controlled device and executed by the program-controlled device, causes the program-controlled device to perform the steps of:

capturing by an optical sensor an optical sensor signal of items to be washed in a dishwasher cavity of the household dishwasher;

ascertaining by an evaluating unit a loading state of the dishwasher cavity as a function of the captured optical sensor signal of the items to be washed; and selecting a wash program from a plurality of wash programs for washing items to be washed as a function of the loading state, wherein the evaluating unit is configured to perform a predetermined action as a funtion of the ascertained loading state, the predetermined action comprising outputting an item of information to a user interface having a display element, and wherein the outputting of the information to the user comprises one of a percentage value of the ascertained loading state on the display element or a graphical representation of the ascertained loading state on the display element.

15. A household dishwasher, comprising:

a dishwasher cavity for accommodating items to be washed;

a controller apparatus configured to perform one wash program from a plurality of wash programs for washing the items to be washed arranged in the dishwasher cavity;

an optical sensor configured to capture an optical sensor signal of the items to be washed arranged in the dishwasher cavity;

an evaluating unit configured to ascertain a loading state of the dishwasher cavity as a function of the captured optical sensor signal of the items to be washed; and an indicating device comprising at least one laser, wherein the evaluating unit is configured to perform a predetermined action as a function of the ascertained loading state, wherein the predetermined action comprises a highlighting of a position in the dishwasher cavity by the indicating device, the highlighting comprising directly marking a particular region in the dishwasher cavity by illuminating the particular region with the at least one laser to indicate space that is still free for items to be washed and wherein the indicating device includes using different illumination colors for different optimization measures and/or signal patterns.

* * * * *